US009364739B2

(12) United States Patent
Reguis et al.

(10) Patent No.: US 9,364,739 B2
(45) Date of Patent: Jun. 14, 2016

(54) ADJUSTABLE FASTENING SYSTEM FOR SLIDING BOARDS AND BOARD EQUIPPED WITH SUCH A SYSTEM

(71) Applicant: Skis Rossignol, Saint-Jean-de-Moirans (FR)

(72) Inventors: Adrien Reguis, Grenoble (FR); Arnaud Repa, Le Fontanil-Cornillon (FR); Vincent Gelin, Mennecy (FR)

(73) Assignee: SKIS ROSSIGNOL, Saint-Jean de Moirans (FR)

( * ) Notice: Subject to any disclaimer, the term of this patent is extended or adjusted under 35 U.S.C. 154(b) by 117 days.

(21) Appl. No.: 14/341,478

(22) Filed: Jul. 25, 2014

(65) Prior Publication Data

US 2015/0031253 A1 Jan. 29, 2015

(30) Foreign Application Priority Data

Jul. 26, 2013 (FR) ..... 13 57369

(51) Int. Cl.

| | |
|---|---|
| ***A63C 10/16*** | (2012.01) |
| ***B63B 35/79*** | (2006.01) |
| ***A63C 5/12*** | (2006.01) |
| ***A63C 10/18*** | (2012.01) |
| ***A63C 10/20*** | (2012.01) |
| ***A63C 10/22*** | (2012.01) |

(52) U.S. Cl.

CPC ..... *A63C 10/16* (2013.01); *A63C 5/128* (2013.01); *A63C 10/18* (2013.01); *A63C 10/20* (2013.01); *A63C 10/22* (2013.01); *B63B 35/79* (2013.01)

(58) Field of Classification Search

None

See application file for complete search history.

(56) References Cited

U.S. PATENT DOCUMENTS

| | | | | | |
|---|---|---|---|---|---|
| 3,810,645 | A * | 5/1974 | Vouthier | ..... | A63C 9/005 280/633 |
| 5,580,201 | A * | 12/1996 | Brilmyer | ..... | F16B 19/02 411/169 |
| 6,007,085 | A * | 12/1999 | Rigal | ..... | A63C 10/20 280/14.24 |

(Continued)

FOREIGN PATENT DOCUMENTS

| | | |
|---|---|---|
| DE | 29501515.2 U | 3/1995 |
| EP | 0 823 268 A | 2/1998 |

(Continued)

OTHER PUBLICATIONS

Search Report and Written Opinion issued by the French Patent Office for priority application FR 1357369 dated Mar. 12, 2014.

*Primary Examiner* — Brodie Follman
*Assistant Examiner* — Hilary L. Johns
(74) *Attorney, Agent, or Firm* — Frommer Lawrence & Haug LLP

(57) ABSTRACT

The present invention relates to a fastening system for a sliding board comprising, respectively, a base delimiting a housing in which a shoe is designed to be immobilized, means for adjusting the position of said base on the board, and a vertical locking pivot cooperating on the one hand with an anchoring element secured to the board, and on the other hand bearing rotational blocking elements supported by a calibrating disc, characterized in that said pivot is made up of an assembly secured to the base comprising a central slug whereof the lower end is designed to be retractably housed in said anchor element and the upper end is connected to at least one rotating maneuvering member ensuring the rotation of said lower end in the anchor element.

The invention also relates to a sliding board equipped with said fastening system.

17 Claims, 6 Drawing Sheets

(56) References Cited

U.S. PATENT DOCUMENTS

| | | | | |
|---|---|---|---|---|
| 6,183,000 | B1 * | 2/2001 | Piatti | A63C 5/03 280/610 |
| 7,287,776 | B2 * | 10/2007 | Papon | A63C 10/20 280/14.22 |
| 2002/0005627 | A1 | 1/2002 | Plassiard | |
| 2013/0257017 | A1 | 10/2013 | Reguis et al. | |

FOREIGN PATENT DOCUMENTS

| | | |
|---|---|---|
| FR | 1 252 863 | 12/1960 |
| FR | 2 811 583 A | 1/2002 |
| FR | 2 988 616 A | 10/2013 |

* cited by examiner

ADJUSTABLE FASTENING SYSTEM FOR SLIDING BOARDS AND BOARD EQUIPPED WITH SUCH A SYSTEM

The present invention relates to an improvement to adjustable fastening systems for sliding boards as well as a board equipped with such a system.

The invention is related to the field of sliding sports, and is more particularly related to specific arrangements of the system for fastening shoes on a snowboard.

In general and traditionally, the fastening devices of a surfboard comprise a base that is designed to be mounted on the upper face of the board.

This base delimits a housing in which a shoe is designed to be immobilized using maintaining means that include a central locking disc cooperating on the one hand with an anchoring element supported by the board, and on the other hand supporting elements for rotational blocking.

Such bases are in particular described in patent FR 2811583 and application FR 12 52863 by this holder.

In application FR 12 52863, the fastener includes a vertical locking pivot connected to the central disc, which can be actuated manually and, furthermore, bearing rotational locking elements supported on a calibrating disc.

This pivot temporarily allows the base to rotate to ensure the adjustment of the angular position of the shoes relative to the axis of the board, their longitudinal position on the board and, if applicable, the separation of the surfer's feet on said board, all at the same time.

This pivot comprises an upper crown for manual tightening extending downward by a threaded axial rod, while the anchor element is made up of a rail containing a nut screwed on the lower end of the rod and offering several longitudinal locking positions of the pivot.

However, the different parts making up this device are only secured to each other when the fastener is mounted on the board and the threaded rod of the pivot is screwed into the nut of the rail.

In fact, the threaded rod that provides the support and axial connection of the adjusting elements does not include any specific means capable of guaranteeing a grouped retention of those elements.

As a result, in the disassembled positions, the pieces of the device, being disengaged, move freely and are therefore capable of scattering, and even being lost in some cases.

In parallel, the mounting of the base on the board requires screwing of the lower end of the threaded rod into the attached nut that is located below the anchor element.

This operation is laborious and delicate, since the nut is a small part that is difficult to access and can move.

The present invention aims to resolve these technical problems in a satisfactory and effective manner by proposing, owing to a simple arrangement, a solution allowing the integration and securing, within the fastening device, of all of its component parts, including the elements designed to ensure its positioning on the board and its adjustment.

This aim is achieved according to the invention using an adjustable fastening system, characterized in that said pivot is made up of an assembly secured to the base comprising a central slug whereof the lower end is designed to be retractably housed in said anchor element and the upper end is connected to at least one rotating maneuvering member ensuring the rotation of said lower end in the anchor element.

According to a first alternative, the calibration disc is positioned on the central slug between its lower end and the maneuvering member.

According to one advantageous embodiment, the base includes at least one central orifice, the lower and upper perimeters of which form stops for circular elements supported by said pivot.

According to one advantageous characteristic, the upper end of said slug is connected on the one hand to a first maneuvering member providing the connection with the anchor element, and on the other hand to a second maneuvering member ensuring the tightening of said rotational blocking elements, said first and second maneuvering members having mutually independent rotational movements.

According to one specific alternative, the upper end of said slug receives a pin jointly ensuring its connection to the first maneuvering member and the strength of the connection between said pivot and the base.

According to another alternative, said first rotating maneuvering member comprises a cup secured to said slug by said pin in order to allow it to rotate in order to provide the connection of its lower end with the anchor element.

Preferably, said cup is associated with a gripping tongue articulated on said pin.

According to still another feature, said slug is provided with an outer thread ensuring, by screwing, its connection to a second maneuvering member.

Advantageously, this thread is provided with an upper stop banking preventing the separation of said second maneuvering member.

According to one particular alternative, said second maneuvering member comprises a knob screwed on said slug below said first maneuvering member.

Preferably, said knob includes a central bush bearing a tapping complementary to the outer threading of the slug.

Advantageously, said knob includes elements for calibrating the rotation of said bush.

Preferably, said knob is supported by a notched crown secured in rotation with the base and delimiting preselected tightening positions thereof.

According to one advantageous feature, the disc, the knob, the bush, the crown, the cup and the tongue are secured to the base on the pivot axis between the lower and upper ends of the slug.

According to one specific alternative, the lower end of the slug bears a cam.

Preferably, this cam has two diametrically opposite fins extending perpendicular to the axis of said slug.

According to a first embodiment, the base includes a lower plate and an upper plate between which the calibrating disc is then captured.

According to a second embodiment, the base includes a single plate, the lower face of which receives a retaining disc and the upper face of which bears the calibrating disc.

The invention also relates to a surfboard equipped with a fastening system comprising the features defined above.

The improved system according to the invention makes it possible to offer surfers an adjustable fastening device in the form of a self-supporting and compact assembly in which all of the parts are preassembled and mutually retained, in particular, all of the parts of the base, calibrating disc and pivot form an integral whole, that is transportable and easily stored.

The risk of lost parts is thus eliminated and the assembly of the device on the board is also made much easier.

This configuration makes the fastening system according to the invention particularly well suited to equipment intended for rental, which requires frequent and fast assembly and disassembly, disparate and bulky storage, as well as many and regular adjustments to different shoe sizes and/or varying individual wishes regarding the position of the surfer's feet.

Furthermore, the system according to the invention secures the packaging and transport, and more generally the logistical management of fastening lots, due to the fact that all of the parts making up the system, including those ensuring its adjustment, are preassembled and remain secured to the base at all times, and in particular in the disassembly position of the system, where the risk of separation of the parts (and, in particular, those making up the pivot) is highest.

The invention will be better understood upon reading the following description, accompanied by drawings explained below.

The fastening system shown in the figures is designed to equip pairs of sliding boards, such as a snowboard S.

As shown in FIGS. 1A, 1B, 2A, 2B and 4, the system assumes the form of a set of parts assembled to each other (some of which may be able to be disassembled and replaced in case of wear), to form a base E delimiting an open housing in which a shoe or a boot (not shown) is designed to be immobilized, for example using maintaining means.

These maintaining means are generally made up of a set of semi-rigid tightening belts or straps provided with a tensioning means situated at the instep and on the firm part of the shoe (not shown).

It is possible to provide an alternative solution with maintaining means of the automatic fitting or "step-in" type.

As shown in detail in FIG. 2, the fastening system includes a pivot 3 with a vertical axis ensuring its complete locking on the board S and cooperating on the one hand with an anchor element secured to said board, and on the other hand with rotational locking elements that are in particular described in application FR 12 52863.

Figure 1A:
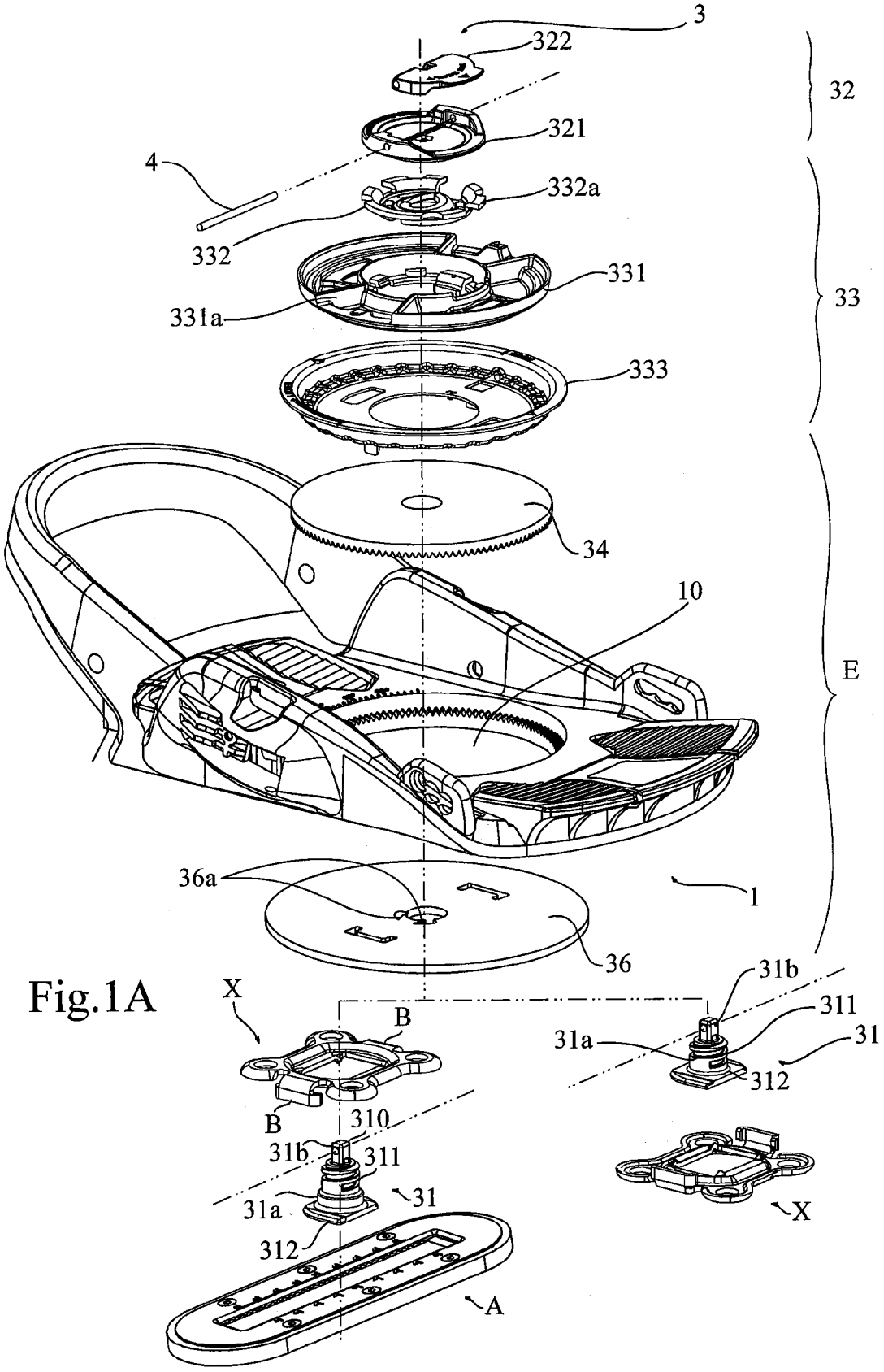
FIGS. 1A and 1B show exploded perspective views of one embodiment of the fastening system according to the invention according to two base alternatives and, for each one, two anchoring solutions on the board (right and left views).
Figure 1B:
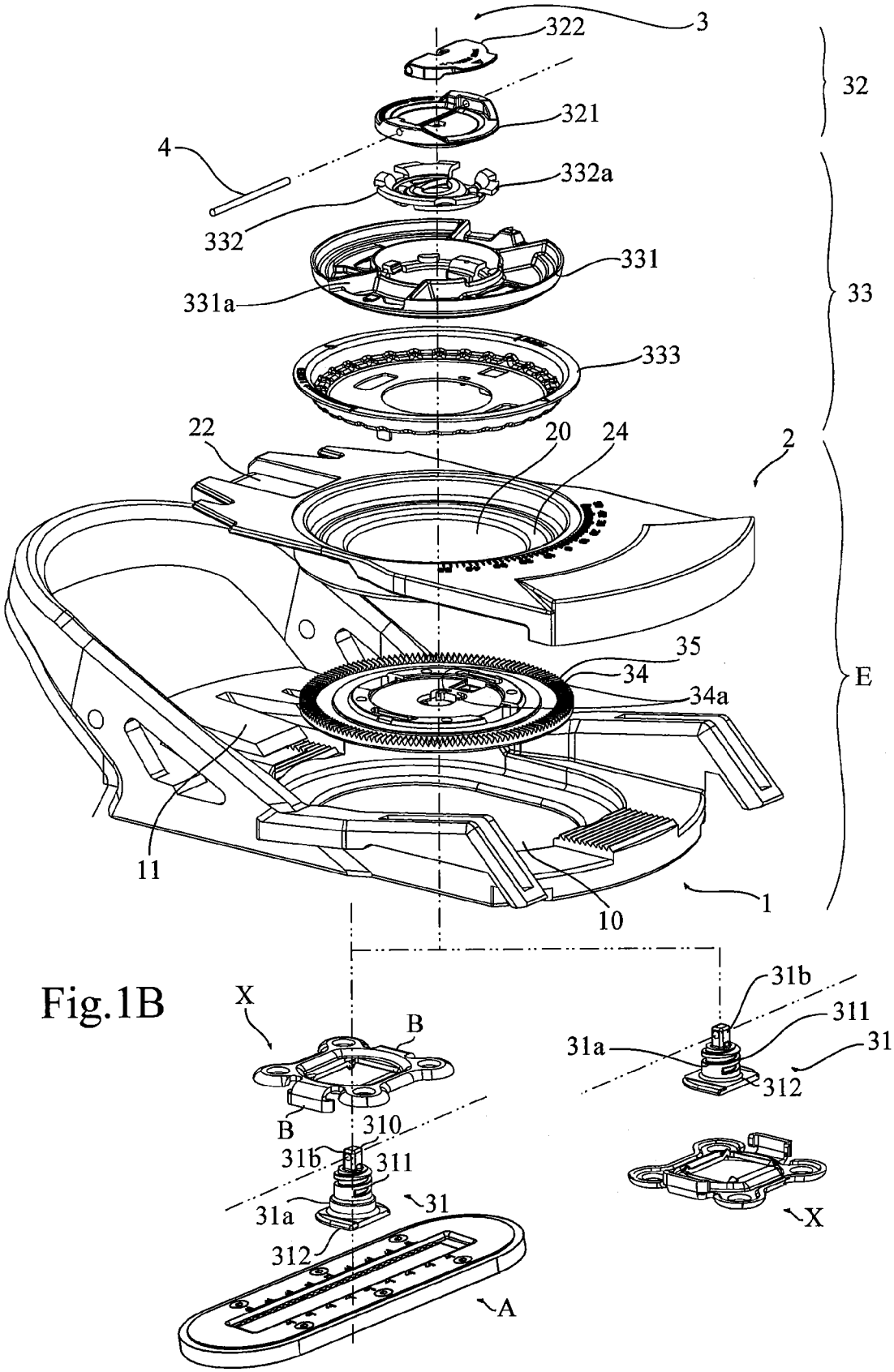

In the embodiment of FIGS. 1A, 1B (left), the anchor element is made of a rail A attached and screwed on the board S or directly incorporated into its structure and which offers several longitudinal positions for placing the fastening device for fastening a shoe.

It would then be possible to provide, without going beyond the scope of the invention, that the board S is equipped with a single longitudinal rail designed to receive two separate fastening systems.

In the alternative shown in FIGS. 1A, 1B (right), the anchor element can also assume the form of a small plate with a single position.

This small plate, which is generally made from metal, is formed by a journal X or simply associated with that journal, which in turn is metallic, and which in turn will be fastened on the board S by four screws.

According to the alternative of the invention that will be used, the journal X will be mounted on part of the pivot 3 or on the board S, then forming an anchor element with a single position.

In a known manner, the body of the base E comprises either a single plate (FIG. 1A), as described in patent FR 2811583, or a lower plate 1 and an upper plate 2 that are rigid (1B), as described in application FR 12 52863, designed to support the shoe and absorb the significant and multidirectional forces created both by the movements of the surfer and by the relief of the trail.

In the embodiment of FIG. 1B, the two plates are preferably capable of sliding relative to one another, in the longitudinal direction of the fastener, to adjust the length of the housing to the shoe size.

The plates 1, 2 are respectively provided with retaining slides and guide elements in order to ensure a sliding mutual connection.

The slides in particular comprise, in the embodiment shown in FIG. 1B, a slot 22 supported by the rear part of the upper plate 2 and in which a tongue 11 is slidingly engaged with a complementary profile supported by the lower plate 1, ensuring the upward retention of the upper plate 2, as shown in FIG. 1B.

Of course, the sliding of the plates, from front to back, is only possible when the surfer has removed his shoes and once the pivot has been unlocked, as will be described later.

The pivot 3 ensures locking of the base E both in rotation and longitudinal sliding relative to the anchoring rail A.

In light of the forces to which the fastening system is subjected and in order to guarantee its complete immobilization on the board during sliding, in particular, in case of slight unscrewing of the pivot, it is provided to reinforce the locking using rotational blocking elements.

However, these elements must be able to be released during adjusting operations to allow both the relative movement of the plates 1, 2 and the adjustment of the angular orientation of the base E.

Thus, the locking of the pivot 3 alone ensures the rotational locking of the base E.

In general and as illustrated by FIGS. 1A and 1B, the lower and upper perimeters of the orifices 10, 20 offer surfaces forming stops for circular or cylindrical elements with a larger diameter supported by the pivot 3, which will be outlined below.

At least one of the orifices 10, 20 receiving the pivot 3 is arranged at the center of a cylindrical shoulder 24 supporting rotational blocking elements on its perimeter.

In the embodiment shown in FIG. 1B, this shoulder 24 is made on the lower face of the upper plate 2 and is engaged in the central basin formed on the upper face of a calibrating disc 34, which in turn supports rotational locking elements 35 that act in a complementary manner and are positioned on its periphery.

The disc 34 is captured between the lower 1 and upper 2 plates and remains permanently secured to the base.

In the embodiment of FIG. 1A, the base E only has a single plate 1 and the calibrating disc 34, which is positioned above that plate, is associated with another circular element formed by a lower disc 36 with axial retention that is positioned below the base E and the diameter of which is larger than that of the orifice 10.

In general, the disc 34 is intended to preserve a fixed angular position relative to the anchoring element A, and therefore relative to the board S.

This result is for example obtained by equipping the disc 34 with a journal X bearing a set of stops B intended to cooperate with the anchor element A to prevent any rotation of the base once it is locked.

As shown in FIGS. 1A and 1B, the journal X is in the form of a substantially flat element provided on the one hand with a central bore, and on the other hand with four peripheral holes designed to receive the mounting screws.

In FIGS. 1A, 1B (bottom part seen from the left), the journal X is oriented such that its stops protrude downward toward the rail A and the screws are then fastened in the disc 34.

This alternative is designed for mounting the fastening device on the board previously equipped with an anchor rail.

The other alternative of FIGS. 1A, 1B (bottom part seen from the right) is designed to mount the fastening system on a board S not provided with a rail. The anchoring element is then made up of a journal X that in turn is reversible and the position of which on the board must be selected beforehand. In that case, the journal must be screwed to a specific location directly on the board (in the upside down position with the stops B oriented upward).

Thus, the user can adapt the method for mounting the fastening system of the invention to the type of surfboard he has (with or without integrated rail), by simply turning over the journal X, delivered with the device.

The shape of the journal is not a constraint in itself, and it may be possible, similarly, to use a circular part such as a washer without going beyond the scope of the invention.

The assembly of the disc, stops and journal could then be made in a single piece.

According to the invention, the pivot 3 is made up of an assembly secured to the base E that comprises, aside from the circular elements (including the disc 34, 36) that will be described below, a central slug 31 whereof the lower end 31*a* bears a connecting element for connecting with the anchoring element, which here assumes the form of a cam 312 designed to be housed and immobilized retractably and reversibly in the rail A.

Figure 3B:
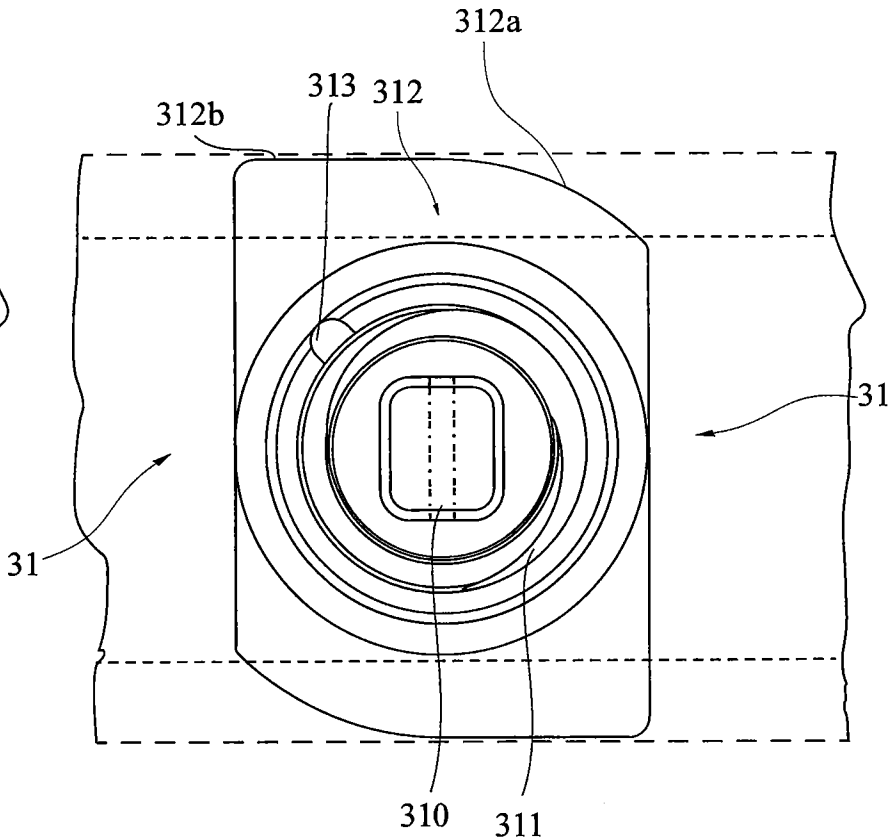
FIGS. 3A and 3B show top views of the slug of the system according to the invention, in the retracted position and in the locked position, respectively.
Figure 3A:
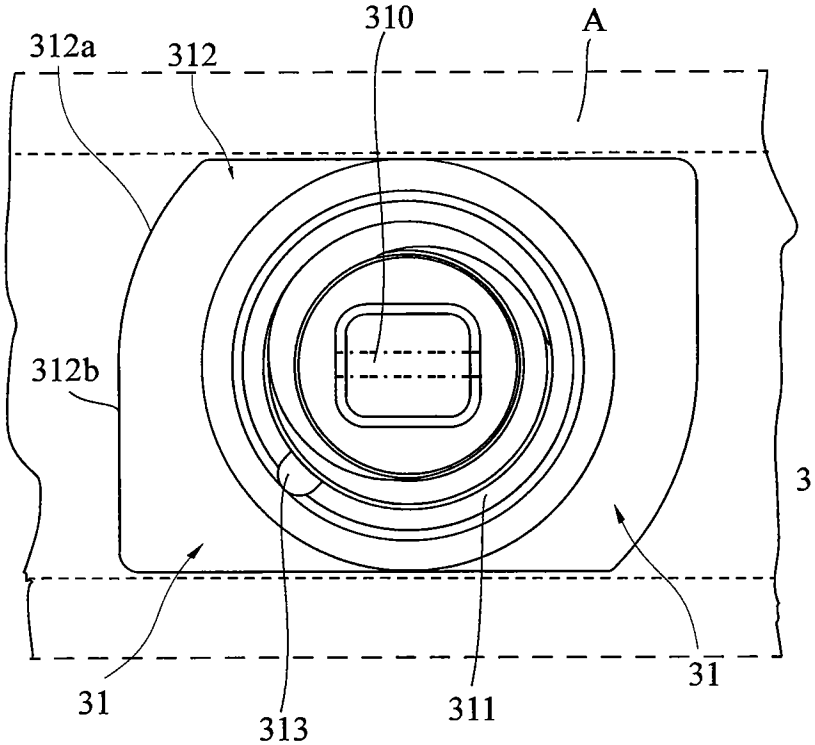
Figure 4:
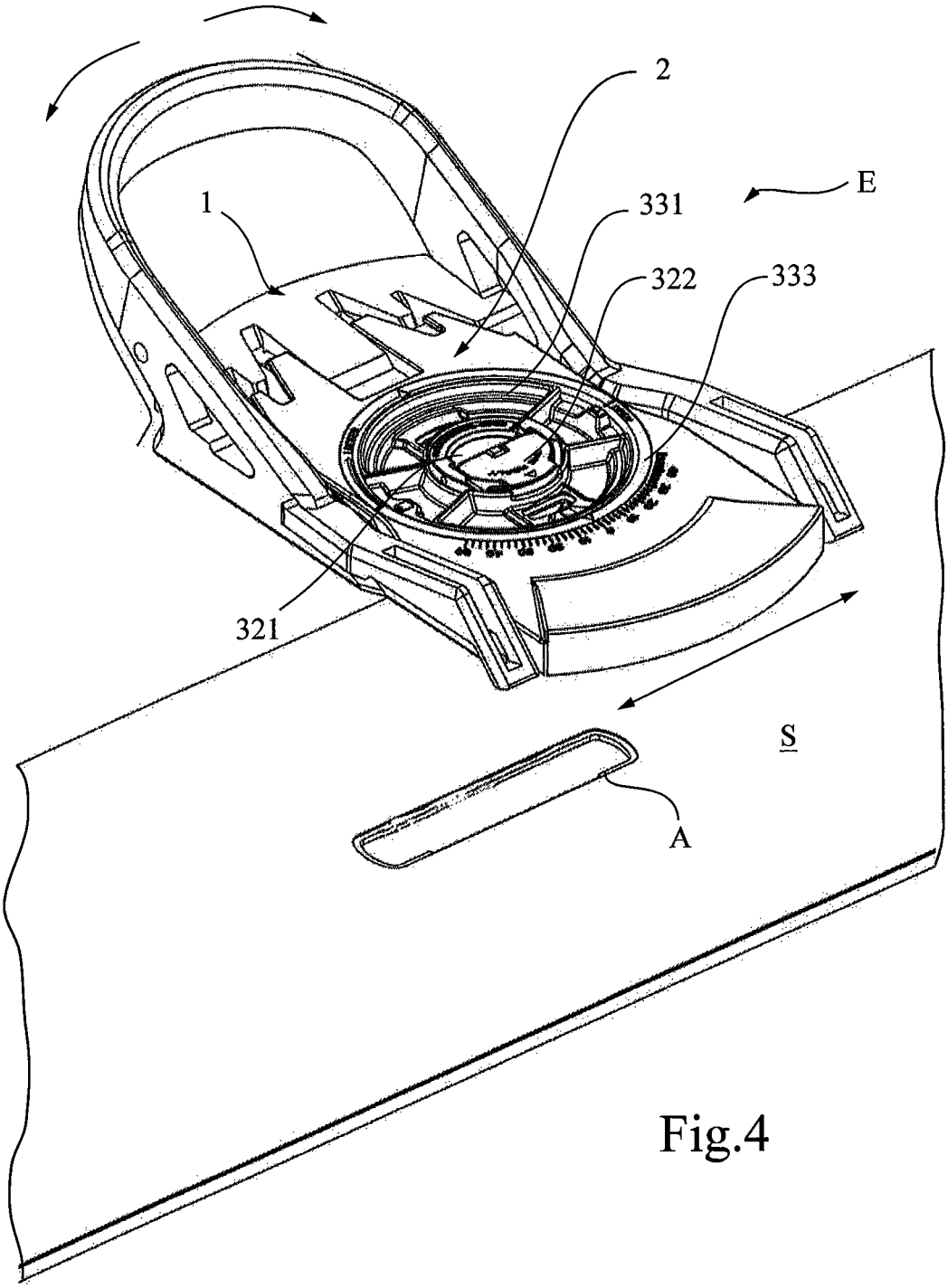
FIG. 4 shows a perspective view of the fastening system according to the invention after its various component elements have been assembled, the base corresponding to that of FIG. 1B and the anchoring element being shown diagrammatically.

The cam here has two diametrically opposite fins extending perpendicular to the axis of the slug, as shown in the figures, and in particular in FIGS. 3A and 3B.

Each of the fins has an outer edge that is delimited by a first curved segment 312*a* facilitating, by guiding against the inner walls of the anchor element, the passage of the cam from its free position (FIG. 3A) to its locked position (FIG. 3B) and vice versa.

This first segment is extended by a second rectilinear segment 312*b* forming a stop banking, at the end of rotation of the cam, against the inner walls of the anchoring element A.

According to different alternatives, it would be possible to make the cam with various profiles (elliptical or polygonal, etc.).

In another alternative that is not shown, it is provided that the lower end 31*a* of the slug 31 has a thread cooperating by screwing with a tapped bore formed in the rail A to ensure the connection between the base E and the board S.

The upper end 31*b* of the slug 31 is connected, in turn, to at least one rotating maneuvering member which, during adjusting, independently ensures anchoring of the cam, then tightening of the rotational blocking elements.

In a preferred embodiment of the invention, which is that shown in the drawings, the upper end 31*b* of the slug 31 is connected on the one hand to a first maneuvering member 32 ensuring, by its rotation, the immobilization of the lower end 31*a*, bearing the cam 312, in the anchoring rail A and, on the other hand, a second maneuvering member 33 ensuring, still by rotation, the tightening of the locking and blocking elements of the fastening system on the board.

The first maneuvering member 32 and the second maneuvering member 33 have angular rotational movement travels that are unique to them and independent of one another.

Thus, as visible in the figures, and in particular in FIGS. 1A, 1B, the pivot 3 is structured as comprising a complex set of parts and circular elements axially assembled and secured to one another via the central slug 31 while having, in the adjustment position of the fastening system, a certain degree of rotational freedom.

In the illustrated embodiment, the upper end 31*b* of the slug 31 receives a pin 4 jointly ensuring its connection to the first maneuvering member 32 and the strength of the connection between the pivot 3 in its entirety in the base E.

Of course, it would be possible to replace the pin with similar fastening means of the threaded rod-nut type without going beyond the scope of the invention.

As shown in FIGS. 1A, 1B, 2A and 2B, the pin 4 is mounted in a transverse duct 310 arranged through the head 31*b* of the slug 31 and that extends on either side until being engaged by its lateral ends in the flanks of the first maneuvering member 32.

This member here is made in the form of a cup 321 associated with a gripping tongue 322 that can be folded down and is articulated on the pin 4, also here forming an axis of rotation.

The rotation of the first maneuvering member makes it possible to ensure the connection of the slug 31 with the anchoring element A.

More specifically, by rotating the cup 321 in either direction using the tongue 322 in the upright position, the cam 312 supported by the lower end 31*a* of the slug 31 is moved from its retracted or insertion position into the rail A (in which the fins extend in the longitudinal axis of the rail A and can move freely in the vertical direction) toward its immobilization position (where the fins are blocked perpendicularly in the rail—FIGS. 2A and 2B) and vice versa.

The result of this operation is to fasten the base E on the board or, in the opposite direction, to release it.

In the illustrated embodiment, this movement represents an angular travel of 90°.

The slug 31 is also provided with an outer thread 311 (FIG. 1) ensuring, by screwing, its connection to the second maneuvering member 33.

For manufacturing reasons (in particular to facilitate the molding of the slug from a plastic material), the slug 31 here is inwardly hollowed out.

The thread 311 is provided with a stop banking in the form of a lug 313, shown in FIGS. 3A and 3B, cooperating with two notches 34*a* or 36*b* respectively formed, in FIG. 1B, in the calibrating disc 34, and in FIG. 1A, on the lower disc 36, to ensure the blocking and calibration of the cam 312 in the anchoring position of the base in the rail A (FIG. 3B).

In the embodiment shown in the figures, the second maneuvering member 33 comprises a series of circular elements, including a knob 331 screwed on the slug 31 below the first maneuvering member 32.

The knob 331 here includes an attached central bush 332 that is preferably made from metal.

This bush bears a tapping complementary to the outer threading of the slug 31. The bush 332 is calibrated in rotation on the knob 331 using click or radial stop elements formed on the upper face of the knob and cooperating with notches 332*a* formed on the periphery of the bush.

The knob 331 bears radial ribs 331*a* facilitating manual engagement in order to impart the rotation.

The knob 331 here is supported freely rotating by a rigid notched crown 333 (potentially made from metal) in contact with the lower face of the knob and delimiting stable preselected tightening positions.

In one alternative that is not shown, it is, however, possible to provide that the circular elements formed in the knob 331, the bush 332 and/or the crown 333 are made in two pieces or a single piece.

Figure 2A:
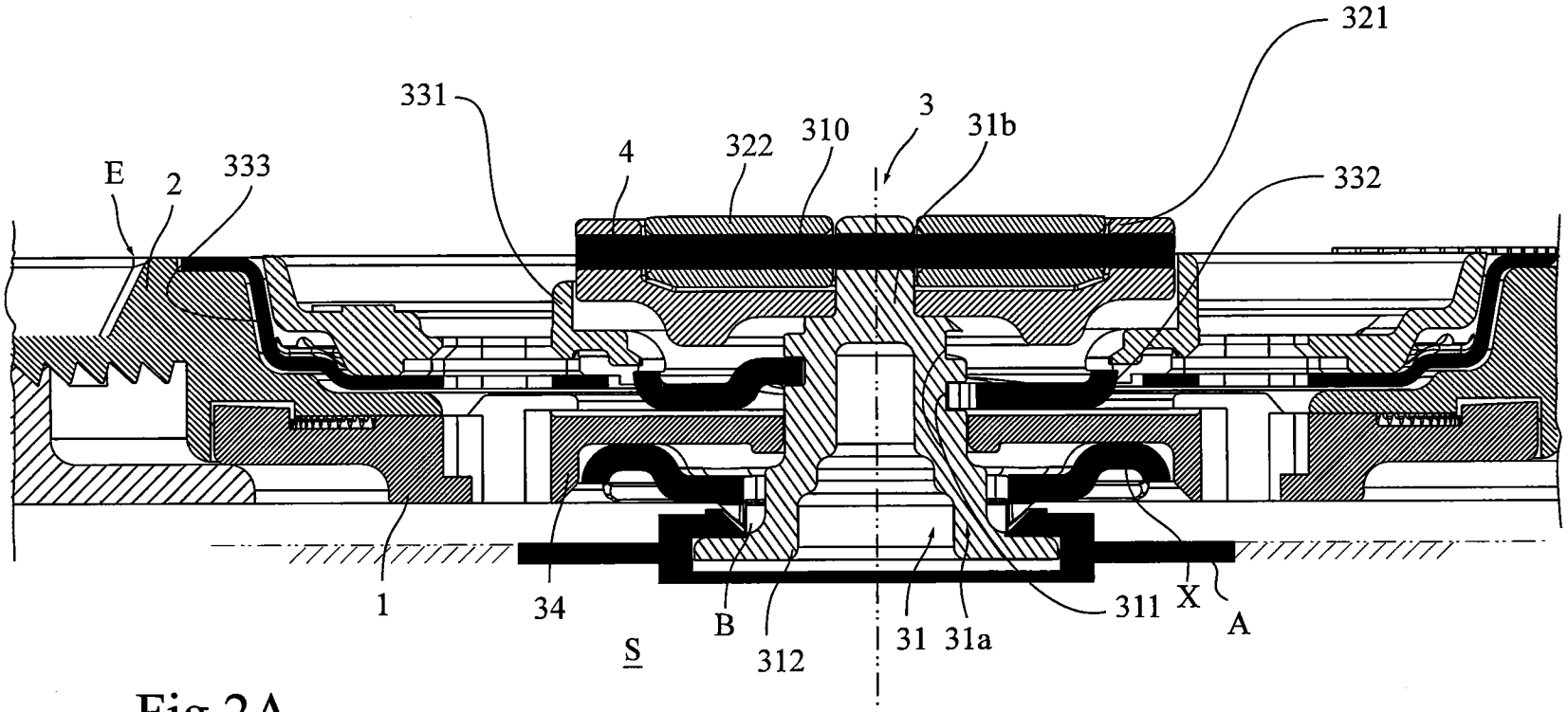
FIGS. 2A and 2B show vertical cross-sectional views along a longitudinal axis of the base of the system of FIG. 1B immobilized perpendicular to the board by anchoring of the base, in the angular adjustment position (freedom of rotation of the base) and the locked position (tightening), respectively.
Figure 2B:
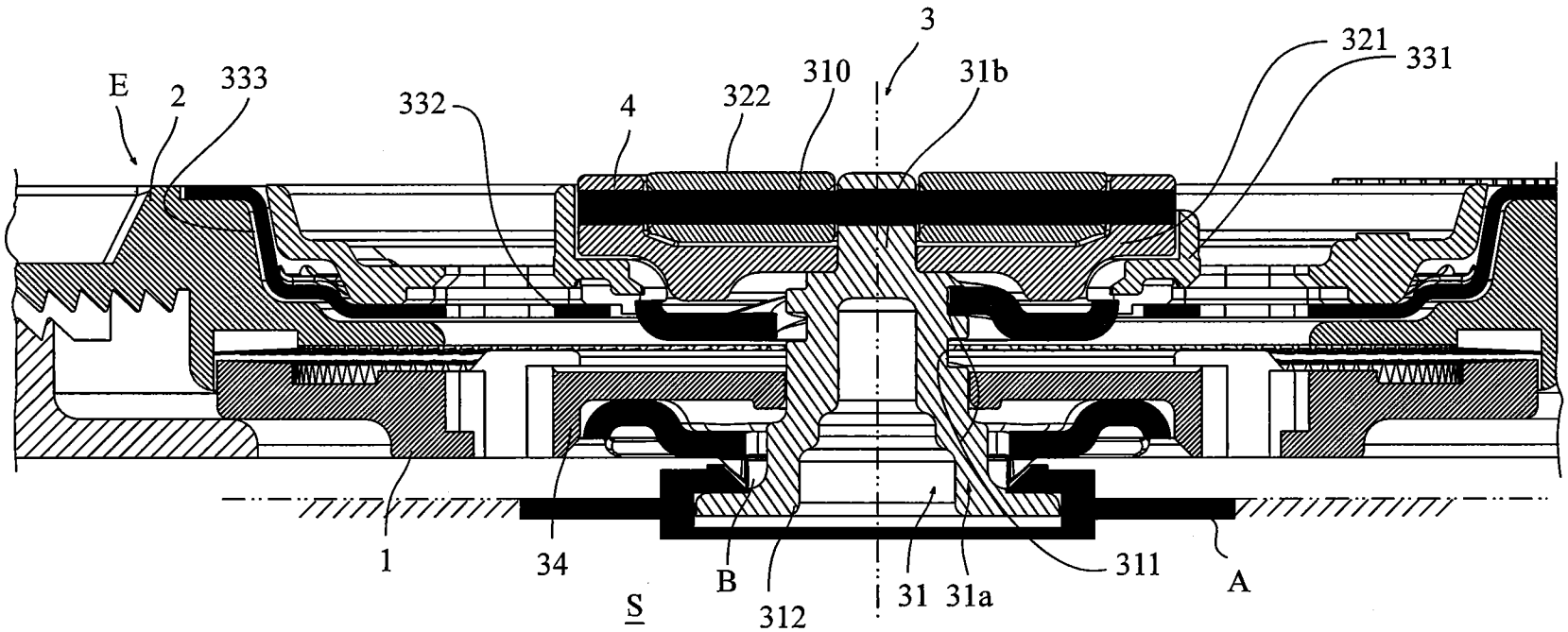

By turning the knob 331 in the clockwise direction, from the position of FIG. 2A, the user ensures the tightening of the second member 33 by screwing, thus causing the forced engagement of the teeth of the calibrating disc 34 in the teeth of the base, thereby locking the rotational blocking elements (FIG. 2B). This result is obtained irrespective of the embodiment of the base (FIG. 1A or 1B).

When the second maneuvering member 33 is loosened, there is then sufficient play between the disc 34 and the base to allow it to be positioned in the desired angular orientation.

In the specific embodiment of FIG. 1B, the tightening of the second member 33 causes the mutual bearing of the upper plate 2 on the lower plate 1 while capturing the disc 34 in an intercalary manner, the teeth of which engage with those of the upper plate 2.

Although the two maneuvering members 32, 33 have their own specific rotational movement freedoms that are independent of one another, the rotational locking operation of the base E is generally done, for ease reasons, once its longitudinal position has been adjusted, the base then already being immobilized on the board S by anchoring of the slug 31 of the pivot 3 in the rail A.

In one alternative that is not shown, the two maneuvering members may be combined into a single maneuvering member.

The mounting and locking operation of the base on the board first requires the rotation of the first maneuvering member by 90°, followed by the rotation of the second maneuvering member by a sufficient angle, preferably 360° (or at least ¾ of a revolution), to ensure tightening of the calibration disc.

For the disassembly operation, the user performs the inverse rotation of the second maneuvering member, followed by a complementary rotation of the first maneuvering member, then leading to the complete release of the base, and thus of the fastening system in its entirety.

Advantageously, in the invention, the first and second maneuvering members can be actuated manually.

However, it would not be beyond the scope of the invention for these maneuvering members to be able to be actuated using one or more tightening tools.

It clearly appears in light of FIGS. 1A and 1B, respectively illustrating the embodiment of the base with a single plate 1 and that with two plates 1, 2, that all of the component elements of the base E remain assembled and connected to each other while being blocked in vertical translation on the axis of the pivot between the lower and upper ends of the slug, even after disassembly and removal of the fastening system from the board.

After disassembly of the fastener, all of the components of the system, and in particular the circular elements, remain on either side of the base without being able to pass through the orifices 10, 20.

In fact, in the alternative of FIG. 1A, the cam 312 of the slug 31 remains blocked below the lower retaining disc 36 because its central orifice has a diameter smaller than the dimensions of the cam, and the disc 36 remains blocked below the base due to the fact that its outer diameter is larger than the inner diameter of the orifice 10.

Furthermore, the disc 34 here abuts against the upper face of the plate 1, since its own diameter is smaller than that of the orifice 10 of said plate.

The disc 34 is in turn supported by the notched peripheral shoulder arranged on the upper perimeter of the orifice 10.

Thus, the upper stack made up of the disc 34 and the maneuvering members formed by the crown 333, the knob 331, the bush 332, the cup 321 and the tongue 322 is assembled to the lower assembly made up of a disc 36 and the slug 31 (and, if applicable, additionally a journal X—left alternative) while capturing the plate 1 in an intercalary manner.

This assembly is locked owing to the insertion of the pin 4 in the transverse duct 310 of the head 31*b* of the slug 31, which protrudes above the stack through the various coaxial orifices of the component elements previously described.

In other words, for the base shown in FIG. 1A, the circular elements formed here by the discs 34 and 36 abut against the plate 1 of the base E, above and below, respectively, the disc 34 being jointly housed in the bore of the orifice 10.

In parallel, in the alternative of FIG. 1B, the cam 312 of the slug 31 remains blocked below the disc 34 because its central orifice has a diameter smaller than the dimensions of the cam, the disc 34 here being immobilized between the two plates 1, 2, which are kept in contact with each other through the contact of the tongue 11 and the slot 22. The upper stack formed by the maneuvering members made up of the crown 333, the knob 331, the bush 332, the cup 321 and the tongue 322 is assembled to the slug 31 (and, if applicable, to the journal X—left alternative) and abuts against the upper face of the base by means of the crown 333, which has a larger diameter than that of the orifice 20 of the upper plate 2. This assembly is locked owing to the insertion of the pin 4 in the transverse duct 310 of the head 31*b* of the slug 31 protruding upward.

In other words, in the configuration of FIG. 1B, the circular elements respectively abut, for the disc 34, between the lower plate 1 and the upper plate 2, and for the crown 333, against the upper face of the upper plate 2 will being housed in the bore of the orifice 20 in contact with the peripheral shoulder 24.

In both configurations of the base E (FIGS. 1A and 1B), the play between the circular elements of the pivot 3 only exists when the base is separated from the board and unlocked.

However, this play is limited by the action of the stops previously described.

The invention makes it possible to have a self-supporting and compact assembly that eliminates any risk of separation, loss or omission of parts, which thereby facilitates the storage and assembly of the fastening system on the boards.

The invention claimed is:

1. A fastening system for a sliding board comprising, respectively, a base delimiting a housing in which a shoe is designed to be immobilized, means for adjusting the position of said base on the board, and a vertical locking pivot cooperating with an anchoring element secured to the board, and bearing rotational blocking elements supported by a calibrating disc, wherein said pivot comprises a central slug whereof the lower end is designed to be retractably housed in said anchor element and the upper end is connected to at least one rotating maneuvering member ensuring the rotation of said lower end in the anchor element, wherein the upper end of said slug is connected to a first maneuvering member and to a second maneuvering member, said first maneuvering member ensuring the rotation of the lower end of the central slug and its connection with the anchor element and said second maneuvering member ensuring the tightening of said rotational blocking elements against the base, said first and second maneuvering members having mutually independent rotational movements.

2. The fastening system according to claim 1, wherein a calibration disc is positioned on the central slug between its lower end and the first and second maneuvering members.

3. The fastening system according to claim 1, wherein said base includes at least one central orifice, the lower and upper perimeters of which form stops for circular elements supported by said pivot.

4. The fastening system according to claim 1, wherein the upper end of the slug receives a pin jointly ensuring its connection to the first maneuvering member and the strength of the connection between the pivot in its entirety in the base.

5. The fastening system according to claim 1, wherein said slug is provided with an outer thread ensuring, by screwing, its connection to said second maneuvering member.

6. The fastening system according to claim 1, wherein the second maneuvering member comprises a knob screwed on the slug below the first maneuvering member.

7. The fastening system according to claim 1, wherein said knob is supported by a notched crown secured in rotation with the base and delimiting preselected tightening positions thereof.

8. The fastening system according to claim 1, wherein the disc and the first and second maneuvering members are secured to the base on the axis of the pivot between the lower and upper ends of the slug.

9. The fastening system according to claim 1, wherein the lower end of the slug bears a cam.

10. The fastening system according to claim 1, wherein the base includes a lower plate and an upper plate between which the calibrating disc is then captured.

11. The fastening system according to claim 1, wherein the base includes a single plate, a lower face of which receives a retaining disc and a upper face of which bears the calibrating disc.

12. A surfboard, equipped with a fastening system according to claim 1.

13. The fastening system according to claim 1, wherein said first maneuvering member comprises a cup rotatably secured to said slug in order to provide the connection of its lower end with the anchor element.

14. A fastening system for a sliding board comprising, respectively, a base delimiting a housing in which a shoe is designed to be immobilized and having at least one central orifice, means for adjusting the position of said base on the board, a vertical locking pivot cooperating through said orifice with an anchoring element secured to the board and comprising, above the base, an upper calibrating disc provided with a central orifice and supporting rotational blocking elements and, below the base, a lower retaining disc provided with a central orifice, wherein said upper calibrating disc and said lower retaining disc have respective outer diameters larger than the inner diameter of the central orifice of the base in order to block the pivot in vertical translation through the base even after removal of the fastening system from the board.

15. The fastening system according to claim 14, wherein said pivot comprises a central slug bearing a cam which remains blocked below the retaining disc because its dimensions are larger than the inner diameter of the orifice of said disc.

16. A fastening system for a sliding board comprising, respectively, a base delimiting a housing in which a shoe is designed to be immobilized and comprising a lower plate and an upper plate, both having one central orifice, means for adjusting the position of said base on the board, a vertical locking pivot cooperating through said orifice with an anchoring element secured to the board and comprising, between the lower plate and the upper plate, a disc provided with a central orifice and supporting rotational blocking elements wherein said disc is immobilized between the two plates and said vertical locking pivot comprises a central slug bearing a cam, the central orifice of the disc having a diameter smaller than the dimensions of the cam in order to block the pivot in vertical translation through the base even after removal of the fastening system from the board.

17. A surfboard, equipped with a fastening system according to claim 16.

* * * * *